United States Patent [19]

Carter, Jr.

[11] Patent Number: 4,865,314

[45] **Date of Patent: * Sep. 12, 1989**

[54] FRAME FOR BARBELL WEIGHTS OR SIMILAR ARTICLE

[76] Inventor: Stanley R. Carter, Jr., 1945 Mathew Dr., Layton, Utah 84041

[ * ] Notice: The portion of the term of this patent subsequent to Sep. 8, 2001 has been disclaimed.

[21] Appl. No.: 93,256

[22] Filed: Sep. 4, 1987

Related U.S. Application Data

[63] Continuation-in-part of Ser. No. 736,958, May 22, 1985, Pat. No. 291,820.

[51] Int. Cl.[4] ..... A63B 13/00

[52] U.S. Cl. ..... 272/123

[58] Field of Search ..... 272/117, 119, 123, 143; 244/265, 266; D21/191, 196, 197, 198

[56] References Cited

U.S. PATENT DOCUMENTS

| | | | |
|---|---|---|---|
| D. 291,820 | 9/1987 | Carter, Jr. | D21/191 |
| 3,332,593 | 7/1967 | Fauser | 224/265 X |
| 3,370,850 | 2/1968 | Moore | 272/119 |
| 3,679,107 | 7/1972 | Perrine | 272/119 X |
| 4,139,132 | 2/1979 | Fairchild, Jr. | 224/265 |
| 4,213,605 | 7/1980 | McPeak | 272/119 |
| 4,391,397 | 7/1983 | Taylor, Jr. | 272/119 X |
| 4,676,502 | 6/1987 | Mahr | 272/123 X |
| 4,722,524 | 2/1988 | Waszkelewicz | 272/123 |

FOREIGN PATENT DOCUMENTS

| | | | |
|---|---|---|---|
| 779572 | 4/1935 | France | 272/123 |

*Primary Examiner*—Richard J. Apley
*Assistant Examiner*—Robert W. Bahr
*Attorney, Agent, or Firm*—W. C. Tupman

[57] ABSTRACT

A weight lifting device having a pair of padded arcurate shoulder engaging members. Rod-like members which project outwardly from the shoulder members are provided with hand grips at their ends. Recesses or spaced raised portions are located on the outwardly projecting members to receive and hold the rod of a barbell. Either an integral connecting rod of the device or the rod of a barbell may be used to maintain the outwardly projecting members in their spaced relationship.

15 Claims, 4 Drawing Sheets

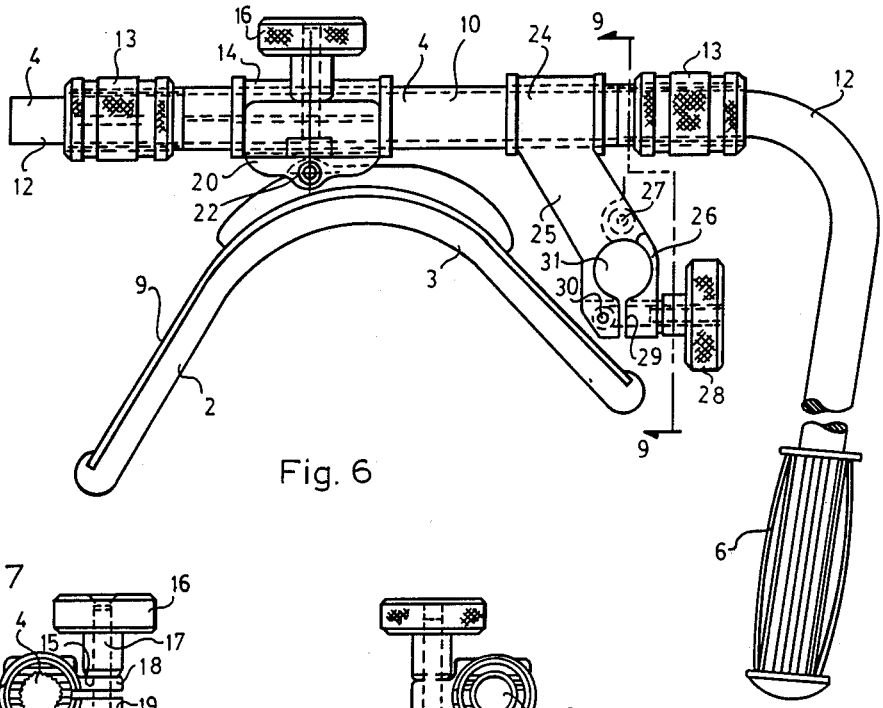
Fig. 6
Fig. 7
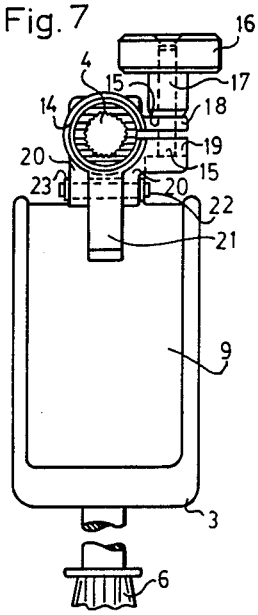
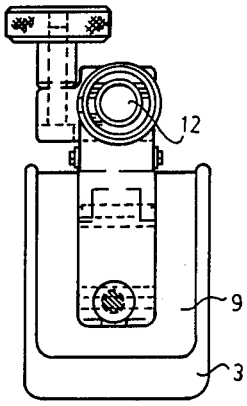
Fig. 9
Fig. 8
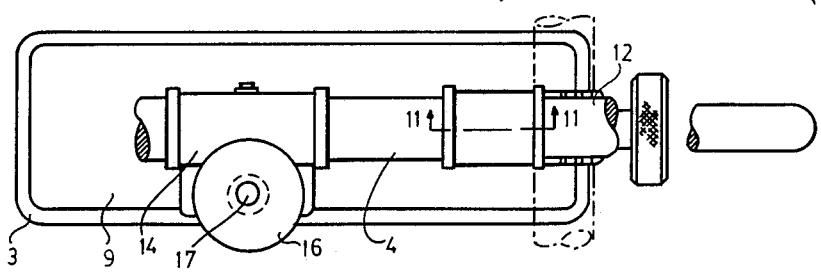

FRAME FOR BARBELL WEIGHTS OR SIMILAR ARTICLE

This application is a continuation-in-part of application Ser. No. 736,958, filed on May 22, 1985, now Design Pat. No. 291,820.

The device of the present invention is an exercising implement and is used to support the rod of a barbell or similar article. The device will support these weights in a position located forward from one's body and is especially helpful when performing exercises involving squats. Thus, the device is very beneficial in exercising one's legs and lower back.

Heretofore, squats have been performed by carrying the weights over the rear of the shoulders which can cause the user to lean forward while exercising, thus possibly causing back strain. Also, if the weights are carried on the front of the shoulders, one must normally exercise with a lower amount of weights. With the present device, an exerciser will be able to use a relatively large amount of weights with a greater degree of balance. Therefore, one's exercising program can be improved, while at the same time easing the possibility of back strain.

BRIEF DESCRIPTION OF THE DRAWING

FIG. 6 is a side elevational view of a modified frame for barbell weights;

FIG. 7 is an end view of the frame of FIG. 6;

FIG. 8 is a top view of the frame of FIG. 6;

FIG. 9 is a sectional view taken along the line 9—9 of FIG. 6;

DETAILED DESCRIPTION OF THE INVENTION

Figure 4:
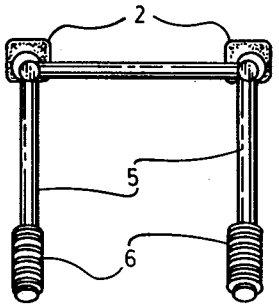
FIG. 4 is a left end view.
Figure 5:
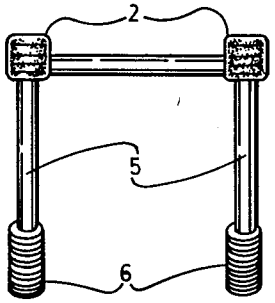
FIG. 5 is a right end view.
Figure 1:
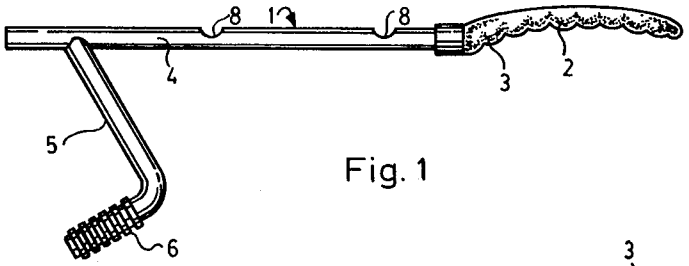
FIG. 1 is a side elevational view of a frame for barbell weights of the present invention.
Figure 2:
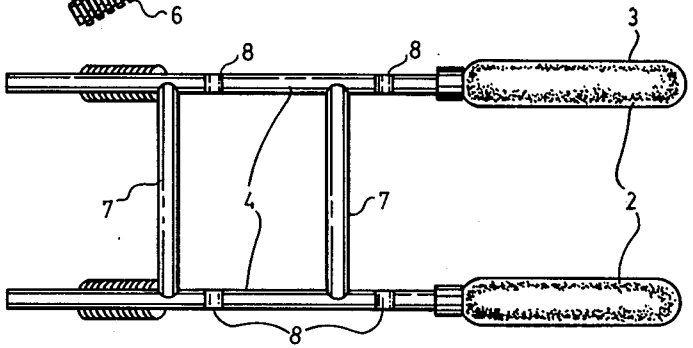
FIG. 2 is a top view.
Figure 3:
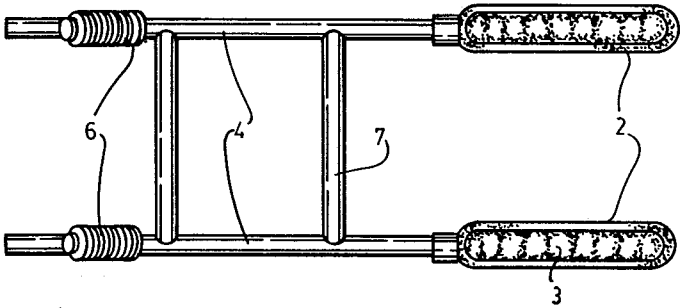
FIG. 3 is a bottom view.

As shown in FIGS. 1–5, the frame 1 comprises a pair of arcuate members 2 at one end which are adapted to rest one one's shoulders when in use. These members 2 comprise an inner rigid element (not shown) and padding material 3 surrounding the outer surface of the rigid element. A pair of rod-like members 4 project outwardly from one end of the arcuate members 2 and are integrally connected to the rigid element thereof. An additional rod-like member 5 is located adjacent the remote end of each member 4 and depends therefrom. Each member 5 is provided with a hand grip 6 at its terminal end. As best shown in FIGS. 2 and 3, a plurality of cross pieces 7 are integrally connected to the members 4, thereby maintaining the members 4 in a fixed spacial relationship. With the rod-like members and the cross pieces being metallic, this integral connection may be obtained by welding the two members together. Two pairs of aligned recesses are located in the members 4. These recesses are adapted to receive and hold the rod-like member of a barbell on the frame when exercising.

While the hand grip 6 is shown at approximately a 45° angle with respect to the members 4, it is to be understood that any angular relationship to the members 4 between a horizontally outward position to a vertically downward position may be used. However, a downwardly projecting hand grip 6 will permit one to use the frame with his upper arms substantially verticle, thereby pushing outwardly on the hand grips. With the hand grips substantially horizontally positioned, the upper part of one's arms would also be more horizontally positioned, thereby requiring a lifting force to support the frame. Also, with the hand grips 6 located below the members 4, a greater lever action is obtained for the frame as a whole, while still maintaining the hand grips relatively close to one's body.

FIGS. 6–12 relate to a variation of my frame 1 from that shown in FIGS. 1–5 and depicts a device having a plurality of adjustments so that the frame may be fitted to one's individual physical size. The basic members of the frame of FIGS. 6–12 are still the same as those of the frame of FIGS. 1–5.

Figure 12:
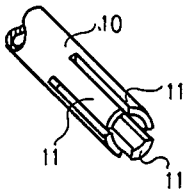
FIG. 12 is a perspective view of one end of the tubular sleeve.

The shoulder piece 2 of FIG. 6 has padding material 3 on its underside thus exposing a rigid element 9. The rod-like members 4 comprise a two piece construction. One piece 10 is a tubular sleeve end as best shown in FIG. 12, is provided with a plurality of fingers 11 at each of its ends. The other piece 12 is positioned within the sleeve 10 and projects not only rearwardly of the sleeve, but also projects from the front of the sleeve wherein the piece 12 depends downwardly and carries a hand grip 6 at this end. Tubular coupling sleeves 13 are located at each end of the sleeve 10 and are provided with a slightly tapered inner surface. By pushing each sleeve 13 toward the other after being positioned over the fingers 11 of sleeve 10, the fingers 11 will be compressed and clamped upon the surface of members 12, thus securing together the two members 10 and 12 of the rod-like member 4. However, the inner surface of the sleeves 13 may be provided with a set of screw threads adapted to mate with screw threads on the outer surface of the fingers 11, thus permitting the two members 10 and 12 to be secured together by screwing the sleeve 13 onto the sleeve 10 to force the fingers against the member 12. Since the member 12 extends beyond the rear of sleeve 10, the hand grips 6 may therefore be adjusted to a large variation of positions away from one's body.

As best shown in FIGS. 6 and 7, a bracket 14 is detachably secured upon the member 4 by the clamping arrangement at 15 which comprises a knob 16 having a screw threaded inner surface adapted to engage the threads of an upwardly positioned T-shaped bolt 17. By turning the knob 16 upon the bolt 17, flanges 18 and 19 are forced together, thus securely clamping the bracket 14 upon the member 4. Lower bracket portions 20 depend from the underside of bracket 14 and are provided with mating openings, while an upwardly extending bracket 21 is carried on the upper surface of the shoulder element 9 and is also provided with an opening. A pin 22 extends through the openings in members 20 and 21 and is secured in place by a clip 23. Thus, the rod-like members 4 are free to pivot with respect to the shoulder pieces 2 about the the pins 22. Also, the relative outward position of the hand grips 6 with respect to the shoulder pieces 2 may be adjusted by selectively clamping the braket 14 along the rod-like member 4 between the sleeves 13.

Another bracket 24 is carried on the member 4 and has a depending member 25 which carries a rod clamping means at its end. The clamping means comprises a member 26 pivotally attached to the depending member 25 at 27. A knob 28 and shaft 29 assembly is pivotally attached to the depending member 25 at 30. After inserting a cross piece rod 32 in the opening 31 in the member 25, the member 26 may be forced and clamped about the rod by actuating the knob 28. With the clamps on the brackets 24 and the use of a cross piece rod 32, the lateral spacing of the two members 4 may be selectively adjusted.

Figure 10:
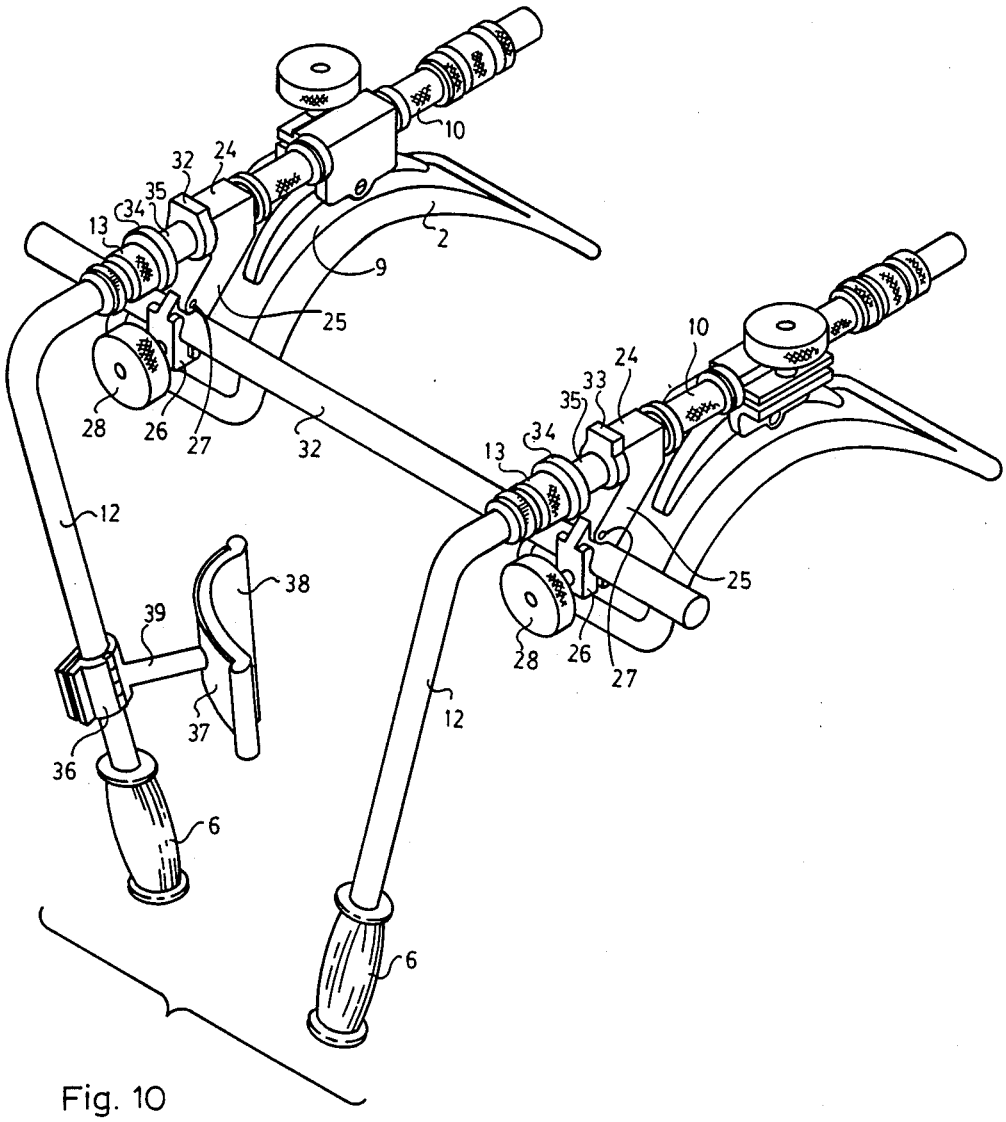
FIG. 10 is a perspective view of a variation of the frame of FIG. 6.
Figure 11:
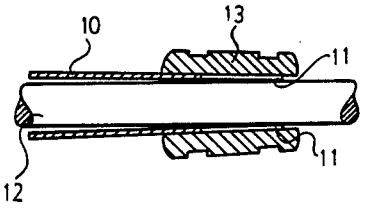
FIG. 11 is a sectional view taken along the line 11—11 of FIG. 8.

As shown in FIG. 10, bracket 24 has a raised portion 33 and sleeve 13 also has a correspondingly raised portion 34. Thus, a U-shaped recess 35 is provided on the upper surface of the members 4 and constitutes a recess to hold and secure the rod of a barbell or similar article when exercising. However, it is to be understood that the separate cross piece rod 32 need not be used. In this instance, the rod of the barbell will constitute a cross piece when selectively adjusted in place within the clamps of bracket 24.

Also shown in FIG. 10, a clamp 36 is secured to the piece 12 above the hand grip 6 and carries an arcuate member 37. The outer surface of member 37 is provided with a pad 38, which is adapted to engage the waist of the person using the frame and thus provides further support for the weights. While not shown, suitable adjustable means may be provided along stem 39 so that the relative distance between the pad 38 and the piece 12 may be varied. A companion waist engaging member may be carried on the other piece 12.

Since various changes may be made in the construction of this frame for barbell weights without departing from the scope of my invention, it is intended that all matter contained in the foregoing description and shown in the accompanying drawing shall be interpreted as illustrative only.

I claim:

1. A weight lifting device comprising a pair of arcuate members adapted to be positioned over a user's shoulders, each member including a rigid element which is covered with padding material or at least one surface, said padding material being adapted to engage the shoulder, an elongated member connected to each element, each elongated member projecting outwardly in the same general direction from said element and terminating in a hand grip, a cross piece member connected to each of said outwardly projecting members thereby maintaining said outwardly projecting members in a spaced relationship with respect to one another, said cross piece being located between said elements and said hand grips, each of said hand grips comprises an elongated portion and a cap member positioned over the end of each of said elongated portions, said caps extending in a direction away from said arcuate members and each being of a sufficient length to readily accommodate the width of a user's hand, whereby said hand grips freely extend at the end of the device opposite to said arcuate members, and means on each of said outwardly projecting members adapted to receive and hold in place an elongated member of a weight lifting appliance, whereby said device can be used in a weight lifting exercise.

2. The device of claim 1, wherein said connection between an outwardly projecting member and said element of said arcuate member comprises a pair of brackets with one bracket being fixed to said element and the other bracket being fixed to said outwardly projecting member, and a pin freely carried in an opening of each bracket, thereby permitting pivotal movement of one bracket relative to the other bracket about said pin.

3. The device of claim 1, wherein each outwardly projecting member is an integral extension of said element of said arcuate member, thereby providing a rigid connection.

4. The device of claim 1, wherein each of said outwardly projecting members comprises a tubular sleeve telescopingly receiving an inner member, said tubular sleeve being connected to one of said elements, while one end of each of said inner members carries one of said hand grips, releasable means clamping said tubular sleeve to said inner member, thereby permitting the position of the hand grips to be adjusted relative to said arcuate members.

5. The device of claim 1, wherein each of said outwardly projecting members comprises a single, one piece member.

6. The device of claim 1, wherein said cross piece comprises an elongated unit, a bracket depending from each of said outwardly projecting members, releasable clamping means carried by each depending bracket adapted to engage said elongated unit at a selected location along the length thereof, whereby the lateral distance between the two outwardly projecting members may be selectively adjusted.

7. The device of claim 1, wherein said cross piece comprises an elongated unit integrally attached at each end to one of said outwardly projecting members.

8. The device of claim 7, including a plurality of cross pieces.

9. The device of claim 1, wherein that portion of said outwardly projecting member which is provided with said hand grip is generally located at approximately right angles with respect to that portion of said outwardly projecting member which is attached to said element.

10. The device of claim 1, wherein that portion of said outwardly projecting member which is provided with said hand grip is generally located at approximately 45° with respect to that portion of said outwardly projecting member which is attached to said element.

11. The device of claim 1, wherein said receiving means comprises a pair of spaced apart raised portions on each of said outwardly projecting members.

12. The device of claim 1, wherein said receiving means comprises a shallow, arcuate recess within each of said outwardly projecting members.

13. The device of claim 12, including a pair of arcuate recesses in each outwardly projecting member.

14. The device of claim 1, wherein each outwardly projecting member is bent at approximately right angles at a location positioned generally midway along its length with the end portion thereof projecting below said arcuate shoulder engaging members and carrying an adjustable bracket, the remote end of said bracket being provided with an arcuate body engaging pad.

15. A weight lifting device comprising a pair of arcuate members adapted to be positioned over the user's shoulders, each member including a rigid element which is covered with padding material on at least one surface, said padding material being adapted to engage the shoulder, an elongated member pivotally attached to each element, each elongated member projecting outwardly in the same direction from said element and terminating in a hand grip, a bracket depending from a mid-portion of each outwardly projecting member, releasable clamping means carried by each depending bracket adapted to engage the elongated member of a barbell unit at a selected location along the length thereof, whereby the lateral distance between the two outwardly projecting members may be selectively adjusted along the barbell unit.

* * * * *

UNITED STATES PATENT AND TRADEMARK OFFICE

CERTIFICATE OF CORRECTION

PATENT NO. : 4,865,314

DATED : September 12, 1989

INVENTOR(S) : Stanley R. Carter, Jr.

It is certified that error appears in the above-identified patent and that said Letters Patent is hereby corrected as shown below:

Column 3, line 45, "or" should be --on--.

Signed and Sealed this

Seventeenth Day of March, 1992

*Attest:*

HARRY F. MANBECK, JR.

*Attesting Officer*

*Commissioner of Patents and Trademarks*